US011535961B2

(12) United States Patent
Uchino

(10) Patent No.: US 11,535,961 B2
(45) Date of Patent: Dec. 27, 2022

(54) MULTI-PLY WOVEN GAUZE FABRIC

(71) Applicant: UCHINO CO., LTD., Tokyo (JP)

(72) Inventor: Nobuyuki Uchino, Tokyo (JP)

(73) Assignee: UCHINO CO., LTD., Tokyo (JP)

( * ) Notice: Subject to any disclaimer, the term of this patent is extended or adjusted under 35 U.S.C. 154(b) by 102 days.

(21) Appl. No.: 17/274,151

(22) PCT Filed: Sep. 6, 2018

(86) PCT No.: PCT/JP2018/033092
§ 371 (c)(1),
(2) Date: Mar. 5, 2021

(87) PCT Pub. No.: WO2020/049696
PCT Pub. Date: Mar. 12, 2020

(65) Prior Publication Data

US 2021/0277549 A1 Sep. 9, 2021

(51) Int. Cl.

| | |
|---|---|
| ***D03D 19/00*** | (2006.01) |
| ***D03D 25/00*** | (2006.01) |
| ***A47K 10/02*** | (2006.01) |
| ***D03D 11/00*** | (2006.01) |
| ***D03D 15/217*** | (2021.01) |

(52) U.S. Cl.
CPC ..... *D03D 19/00* (2013.01); *A47K 10/02* (2013.01); *D03D 11/00* (2013.01); *D03D 15/217* (2021.01); *D03D 25/005* (2013.01)

(58) Field of Classification Search
CPC ..... D03D 19/00; D03D 11/00; D03D 15/217; D03D 25/005; D03D 13/004; D03D 15/41; A47K 10/02
See application file for complete search history.

(56) References Cited

U.S. PATENT DOCUMENTS 5,632,072 A * 5/1997 Simon ..... D06C 23/00 26/69 R
5,851,496 A * 12/1998 Sakurai ..... F01N 3/2026 422/174

(Continued)

FOREIGN PATENT DOCUMENTS

CN 101311400 A 11/2008
CN 104583479 A 4/2015

(Continued)

OTHER PUBLICATIONS

CNIPA, Chinese Office Action and Search Report dated Aug. 30, 2021 in Chinese Application No. 201880097186.3, 7 pages.

(Continued)

*Primary Examiner* — Robert H Muromoto, Jr.
(74) *Attorney, Agent, or Firm* — Peter Martinez; Masuvalley & Partners

(57) ABSTRACT

A multi-ply woven gauze that has loft, a soft texture, and superior heat retention, permeation resistance, and lightness of weight. The multi-ply woven gauze includes a front surface layer formed with a plain-weave structure, an intermediate layer formed with a waffle-weave structure, and a rear surface layer formed with a plain-weave structure. The front surface layer and the intermediate layer are joined together, and the rear surface layer and the intermediate layer are joined together. Wrinkles form at the connections between the front surface layer and the rear surface layer due to the difference in contraction between the plain-weave structures and the waffle-weave structure. The intermediate layer is formed from at least one layer. The weave density of a single layer in the intermediate layer is equal to or half the weave density of the front surface layer and the rear layer.

9 Claims, 14 Drawing Sheets

(56) References Cited

U.S. PATENT DOCUMENTS

| | | | | |
|---|---|---|---|---|
| 6,418,974 | B1 * | 7/2002 | King | B01D 46/0001 442/205 |
| 7,637,573 | B2 * | 12/2009 | Bajic | B60N 2/5685 297/180.12 |
| 2004/0036326 | A1 * | 2/2004 | Bajic | B60N 2/5657 297/180.14 |
| 2009/0302072 | A1 * | 12/2009 | Lang | B05B 11/3097 222/571 |
| 2010/0248574 | A1 * | 9/2010 | King | E02D 17/202 442/205 |
| 2016/0102422 | A1 * | 4/2016 | Hozumi | D03D 15/573 442/194 |
| 2016/0201233 | A1 * | 7/2016 | Hozumi | D03D 11/00 442/246 |
| 2016/0281276 | A1 * | 9/2016 | Hozumi | B32B 5/028 |
| 2017/0204542 | A1 * | 7/2017 | Perrin | D03D 13/004 |
| 2018/0298528 | A1 * | 10/2018 | Hozumi | A47K 10/02 |
| 2022/0081809 | A1 * | 3/2022 | Kozuka | D06C 7/00 |

FOREIGN PATENT DOCUMENTS

| | | | |
|---|---|---|---|
| CN | 106319721 | A | 1/2017 |
| CN | 207079341 | U | 3/2018 |
| CN | 207391663 | U | 5/2018 |
| CN | 207711524 | U | 8/2018 |
| JP | 2004-107823 | A | 4/2004 |
| JP | 2012-001847 | A | 1/2012 |
| JP | 5435607 | B1 | 3/2014 |
| JP | 5534383 | B1 | 5/2014 |
| KR | 20010096071 | A | 11/2001 |
| WO | WO 2010/107376 | A1 | 9/2010 |
| WO | WO 2015/029184 | A1 | 3/2015 |
| WO | WO 2018/150763 | A1 | 8/2018 |

OTHER PUBLICATIONS

TIPO, Decision of Refusal dated Oct. 14, 2020 in Taiwanese Application No. 108130420, 5 pages.

TIPO, Taiwanese Office Action dated May 5, 2020 in Taiwanese Application No. 108130420, 7 pages.

JPO, Decision to Grant a Patent dated Mar. 13, 2019 in Japanese Application No. 2018-564986, with English translation, 5 pages.

JPO, Japanese Office Action dated Jan. 30, 2019 in Japanese Application No. 2018-564986, with English translation, 4 pages.

WIPO, Japanese International Search Authority, International Search Report (with English translation) and Written Opinion dated Nov. 27, 2018 in International Patent Application No. PCT/JP2018/033092, 8 pages.

* cited by examiner first example

G warp 16 X weft 16
H warp 8 X weft 8 appearance of first example

G warp 16 X weft 16
H warp 8 X weft 8 third example

G 1.0

H 1.0

G 1.0

G warp 16 X weft 16
H warp 16 X weft 16 forth example

G warp 16 X weft 16
H warp 16 X weft 16 comparative example 1 comparative example 2

| | comparative example 1 | comparative example 2 | example 3 | example 1 |
|---|---|---|---|---|
| conceptual diagram |  |  |  |  |
| Weight ($g/m^2$) | 170.3 | 163.2 | 210 | 200.9 |
| Thickness (mm) | 0.91 | 1.36 | 2.33 | 2.62 |
| light property =weight / thickness | 187.14 | 120.00 | 90.13 | 76.68 |
| heat-retaining property (%) | 34.9 | 36.8 | 56.7 | 58.1 |
| Breathability ($cm^3/cm^2 \cdot s$) | 155.4 | 135.8 | 128.7 | 128.7 |

| | comparative example 3 | comparative example 4 | example 3 | example 1 |
|---|---|---|---|---|
| conceptual diagram |  |  |  |  |
| Weight ($g/m^2$) | 195.9 | 197.7 | 210 | 200.9 |
| Thickness (mm) | 1.09 | 1.69 | 2.33 | 2.62 |
| light property =weight / thickness | 179.72 | 116.98 | 90.13 | 76.68 |
| heat-retaining property (%) | 40.2 | 43.4 | 56.7 | 58.1 |
| Breathability ($cm^3/cm^2 \cdot s$) | 186.0 | 158.3 | 128.7 | 128.7 | schematic structural view of honeycomb weave structure reference example appearance of first & second middle layers in first example second middle layer first middle layer

MULTI-PLY WOVEN GAUZE FABRIC

RELATED APPLICATIONS

This application is the U.S. National Phase of and claims priority to International Patent Application No. PCT/JP2018/033092, International Filing Date Sep. 6, 2018, entitled Multi-Ply Woven Gauze; which is incorporated herein by reference in its entirety.

TECHNICAL FIELD

The present invention relates to a gauze fabric. Specifically, the present invention relates to a multi-ply woven gauze fabric in which a surface layer and a back layer are formed into a plain weave construction and a middle layer is formed into a honeycomb weave construction.

BACKGROUND ART

A gauze fabric is a flat woven fabric that is coarsely woven by using a relatively thin yarn.

In general, the gauze fabric employs a solid (not hollow) twisted cotton yarn. The cotton gauze fabric includes several types such as a single woven fabric, a double woven fabric, and a triple woven fabric. The single gauze fabric is employed for, for example, a medical use and dishcloth. The double gauze fabric is employed for, for example, clothing and handkerchiefs. The pure cotton yarn (mainly a single yarn having the English cotton count of 40) is employed. The triple gauze fabric is employed for, for example, towels and bed and bedding. The pure cotton yarn is employed.

In a structure of the single woven fabric that employs the single cotton yarn having the English cotton count of 40, a typical density is the total 50-120 warp and weft yarns per inch (e.g., 32 warp yarns+28 weft yarns=the total 60 yarns). If the density is below the total 50 warp and weft yarns per inch, the resulting fabric fails to compose gauze. In a case of a fabric having a high density, i.e., the density over the total 120 warp and weft yarns per inch, the fabric is not generally referred to as gauze.

FIG. 7 illustrates a cross section of a typical triple gauze fabric. The triple gauze fabric includes a surface layer, a back layer, and a middle layer. Each layer is formed into a gauze structure. The gauze structure is composed of a warp yarn (lengthwise yarn) and a weft yarn (crosswise yarn). While the warp yarn is supplied, the weft yarn is drawn across the warp yarn. The gauze structure of a plain weave construction is thereby formed. While the surface layer, the middle layer, and the back layer are formed, the surface layer and the middle layer and the back layer and the middle layer, respectively, are joined together via connection parts with proper timing. As illustrated, the connection parts may be formed by the warp yarn, or the connection parts may be formed by the weft yarn. Alternatively, the joining between the surface layer and the back layer may achieve the joining between the surface layer and the middle layer and the joining between the back layer and the middle layer.

The gauze is a coarse-meshed fabric (having a large gap between yarns). Because the gauze is the coarse-meshed flat woven fabric, it has an excellent breathability and an excellent lightness.

On the other hand, the gauze fabric is poor in heat-retaining property. Because the gauze fabric is still thin even when it is formed into a multi-ply gauze, the heat-retaining property cannot be expected. If the number of gauze fabrics is increased for the purpose of obtaining the heat-retaining property of a satisfactory level, the lightness thereof is spoiled remarkably.

Because the gauze is the coarse-meshed fabric, it is poor in bounce and softness.

Because the gauze is the coarse-meshed fabric, the skin is easy to be seen through the gauze when it is employed for, for example, clothes. Here, if a yarn having a large diameter is used or if the gauze is formed to have a high density, the transparency preventing property improves, but the breathability and the lightness, which are the advantageous characteristics of the gauze, are spoiled remarkably.

For the reasons as set forth above, the properties of the conventional multi-ply woven gauze fabric are not satisfactory enough to the extent that the conventional multi-ply woven gauze fabric is applied to a cloth for clothes and bedding. Therefore, the present inventor deemed that the conventional multi-ply woven gauze fabric needs further improvement.

By the way, in pile towels, non-twisted yarn piles and/or soft twist yarn piles are sometimes used.

A typically used twisted yarn is formed by twisting raw cotton fibers. Compared with this, a non-twisted yarn is formed by untwisting a twisted yarn to put the twisted yarn in a non-twisted state. More specifically, a water-soluble yarn is twisted in a reverse direction of the twisted yarn, and weaving is performed by using thus obtained conjugated yarn. Then, the water-soluble yarn is dissolved and removed, thereby obtaining a yarn in the non-twisted state.

The non-twisted yarn puffs and swells to retain a large amount of air between fibers. As a result, the non-twisted yarn piles achieve the heat-retaining property and a feel of soft touch.

The soft twist yarn is formed by untwisting a twisted yarn in the same way as it is done for the non-twisted yarn but in a manner to remain a twisting state of the twisted yarn. The soft twist yarn has properties approximate to those of the non-twisted yarn.

The present inventor conducted intensive studies about application of the non-twisted yarn or the soft twist yarn to the gauze fabric. The gauze structure composed of the non-twisted yarn or the soft twist yarn has bulkiness, when compared with the gauze structure composed of the twisted yarn, while keeping the breathability and the lightness. As a result, the heat-retaining property, the feel of soft touch, and the transparency preventing property improve.

In general, the non-twisted yarn and the soft twist yarn are, however, poor in strength in comparison with the twisted yarn. Therefore, the gauze structure composed of only the non-twisted yarn is poor in strength. The gauze structure composed of only the soft twist yarn is also poor in strength. Even if a multi-ply gauze is formed by the above-described gauzed structure, the multi-ply gauze still fails to achieve a remarkable improvement in strength.

In view of the above, the present inventor conducted intensive studies about application to the multi-ply woven gauze fabric in which the gauze structure composed of the twisted yarn and the gauze structure composed of the non-twisted yarn (or the soft twist yarn; the same applies hereinafter) are joined together.

The gauze structure composed of the twisted yarn maintains the strength, and the gauze structure composed of the non-twisted yarn provides the heat-retaining property, the feel of soft touch, and the transparency preventing property as well. More specifically, the combination provides advantageous properties of both gauze structures.

The present inventor proposes, as related inventions, multi-ply woven gauze fabrics according to, for example, Patent Document 1 and Patent Document 2.

FIG. 8 illustrates a cross section of the triple gauze fabrics according to the related inventions. The triple gauze fabrics according to the related inventions each employs a non-twisted yarn for a surface layer and a back layer and employs a twisted yarn for a middle layer. As a result, wrinkles occur due to a differential shrinkage between the non-twisted yarn and the twisted yarn. Owing to the bulkiness caused by the wrinkles, the feel of soft touch improves more than imagined from an effect of the mere use of the non-twisted yarn.

Similarly, owing to the bulkiness caused by the wrinkles, the heat-retaining property and the transparency preventing property also improve more than imagined from the effect of the mere use of the non-twisted yarn.

Further, weight is substantially equivalent to each other. In other words, the triple gauze fabric is lighter than imagined from its puffy appearance, i.e., the lightness also improves.

CITATION LIST

Patent Literature

[PATENT LITERATURE 1]JP 5435607 B
[PATENT LITERATURE 2]JP 5534383 B

SUMMARRY OF INVENTION

Technical Problem

As described above, in the triple gauze fabrics according to the related inventions, owing to the bulkiness caused by the wrinkles, the feel of soft touch, the heat-retaining property, the transparency preventing property, and the lightness improve more than imagined from the effect of the mere use of the non-twisted yarn.

But there was a limit in bulkiness even with the wrinkles caused by the differential shrinkage between the non-twisted yarn and the twisted yarn.

As a result, there was also a limit in improvement of the feel of soft touch, the heat-retaining property, the transparency preventing property, and the lightness.

The present invention is made to solve the above-described problems. A purpose of the present invention is to provide a multi-ply woven gauze fabric having more bulkiness and being excellent in feel of soft touch, heat-retaining property, transparency preventing property, and lightness.

Solution to Problem

To solve the above-described problems, the multi-ply woven gauze fabric of the present invention includes a surface layer that is formed into a plain weave construction, a middle layer that is formed into a honeycomb weave construction, and a back layer that is formed into the plain weave construction. The surface layer and the middle layer are joined together via connection parts, and the back layer and the middle layer are joined together via connection parts. The connection parts are made at apex parts of the honeycomb weave construction.

With the structure, wrinkles are formed between the connection parts in the surface layer and the back layer.

The bulkiness improves remarkably due to a synergistic effect between the bulkiness caused by the wrinkles and the bulkiness that the honeycomb weave construction originally has.

Preferably, the surface layer and the back layer are formed of a non-twisted yarn or a soft twist yarn.

The bulkiness further improves owing to a differential shrinkage caused between the twisted yarn and the non-twisted yarn (or the soft twist yarn).

Preferably, the surface layer and the back layer are formed of the twisted yarn.

Accordingly, the noticeable bulkiness can be produced even without using the non-twisted yarn. This contributes to the reduction of the manufacturing cost.

Preferably, the middle layer includes a first middle layer and a second middle layer, warp densities of the first middle layer and the second middle layer are half of warp densities of the surface layer and the back layer, and weft densities of the first middle layer and the second middle layer are half of weft densities of the surface layer and the back layer.

Preferably, the middle layer is a single layer, the warp density of the middle layer is identical to the warp densities of the surface layer and the back layer, and the weft density of the middle layer is identical to the weft densities of the surface layer and the back layer.

In other words, the multi-ply woven gauze fabric has an amount of structure almost identical to that of a typical triple gauze fabric (about the same weight). In having about the same weight, the bulkiness improves remarkably.

Preferably, the middle layer includes first to fourth middle layers, the warp densities of the first to fourth middle layers are half of the warp densities of the surface layer and the back layer, and the weft densities of the first to fourth middle layers are half of the weft densities of the surface layer and the back layer.

Preferably, the middle layer includes a first middle layer and a second middle layer, the warp densities of the first middle layer and the second middle layer are identical to the warp densities of the surface layer and the back layer, and the weft densities of the first middle layer and the second middle layer are identical to the weft densities of the surface layer and the back layer.

In other words, the multi-ply woven gauze fabric has the amount of structure almost identical to that of a typical four-ply gauze fabric (about the same weight). In having about the same weight, the bulkiness improves remarkably.

Advantageous Effect of Invention

In the multi-ply woven gauze fabric of the present invention, the bulkiness improves. As a result, the feel of soft touch, the heat-retaining property, the transparency preventing property, and the lightness improve.

DESCRIPTION OF EMBODIMENTS

~Summary~

Figure 1:
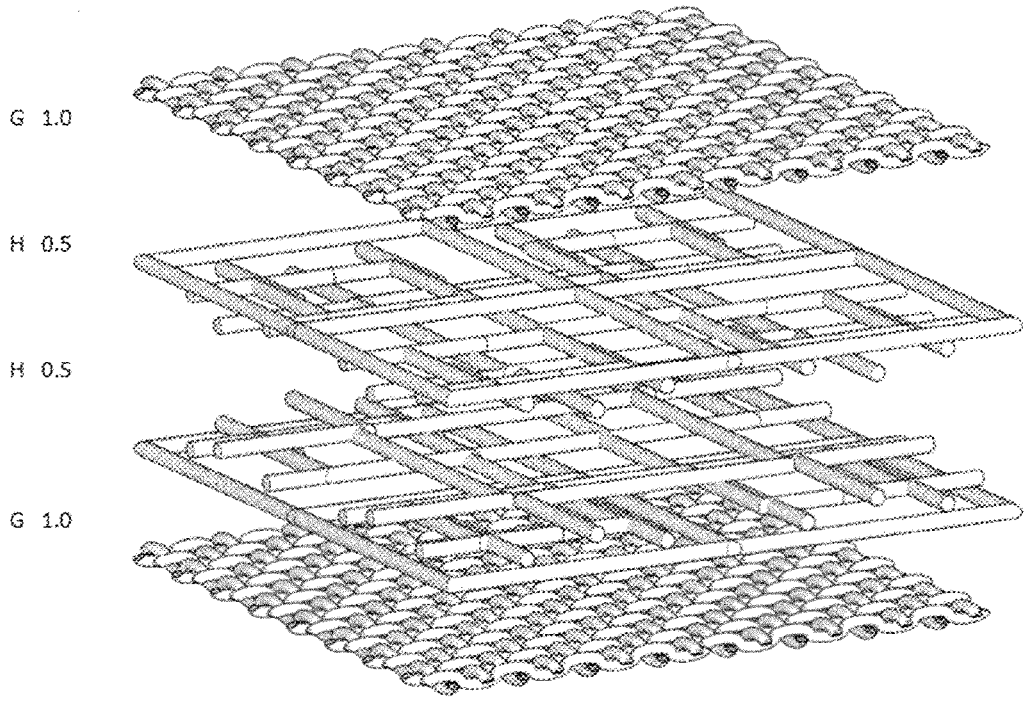
FIG. 1 schematically illustrates a multi-ply woven gauze fabric according to First Embodiment.

The present embodiment is directed to a multi-ply woven gauze fabric which includes a surface layer, a middle layer, and a back layer. The surface layer and the middle layer are joined together via connection parts, and the back layer and the middle layer are joined together via connection parts.

The connection parts may be formed of the warp yarn or, alternatively, the connection parts may be formed of the weft yarn. The yarn of the surface layer may be brought into joining with the middle layer or, alternatively, the yarn of the middle layer may be brought into joining with the surface layer. The yarn of the back layer may be brought into joining with the middle layer or, alternatively, the yarn of the middle layer may be brought into joining with the back layer. Further alternatively, the joining between the surface layer and the back layer may achieve the joining between the surface layer and the middle layer and may further achieve the joining between the back layer and the middle layer.

The surface layer and the back layer are composed of the warp yarn (lengthwise yarn) and the weft yarn (crosswise yarn). The weft yarn is supplied to cross with the warp yarn, thereby causing the layers to be formed into a plain weave construction.

As the warp yarn and the weft yarn to be used for forming the surface layer and the back layer, a yarn having the (English) cotton count of, preferably, a range between 16 and 60 (single yarn conversion) is employed. Further preferably, a yarn having the (English) cotton count of a range between 20 and 40 is employed.

When using a fine count yarn, the structure is formed to have a high density. An upper limit of the density is to be set to 40 warp yarns/inch and 40 weft yarns/inch.

When using a thick count yarn, the structure is formed to have a low density. A lower limit of the density is to be set to 24 warp yarns/inch and 24 weft yarns/inch.

Further, when using a yarn having the yarn count of the range between 20 and 40, a preferable density is to be set to 26-34 warp yarns/inch and 26-34 weft yarns/inch.

With the above-described structure, the surface layer and the back layer are formed into a typical gauze fabric (plain weave construction).

The middle layer is composed of the warp yarn and the weft yarn and is formed into a honeycomb weave construction. The honeycomb weave construction is formed in such a manner that the warp yarn and the weft yarn are elongated and floated to be woven into a concave/convex diamond shape or a concave/convex square shape on both surfaces. The honeycomb weave is sometimes referred to as "waffle fabric" because it has a texture alike the snack of Waffle. Here, the middle layer having the honeycomb weave construction of the present invention slightly differs from the waffle weave towels commercially available in the market (will be described below).

As the warp yarn and the weft yarn to be used for forming the middle layer, a yarn having the (English) cotton count of, preferably, a range between 10 and 40 (single yarn conversion) is employed. Further preferably, a yarn having the (English) cotton count of a range between 15 and 30 is employed.

A construction density of the middle layer is, in consideration of the number of reed marks (dents), about the same as those of the surface layer and the back layer (see, Third and Fourth Embodiments). In other words, the total number of the lengthwise and crosswise yarns per inch is preferably a range between 48 and 80 yarns. Here, it is more preferred if the construction density of the single middle layer is set to the half of the construction densities of the surface layer and the back layer (see, First and Second Embodiments) (will be described below).

One repeat for constituting the honeycomb weave construction is formed to have a density of a range between 8 warp yarns×8 weft yarns and 28 warp yarns×28 weft yarns. Further, preferably, it is formed to have a density of a range between 12 warp yarns×12 weft yarns and 16 warp yarns×16 weft yarns.

When considering the construction density of the middle layer, the one repeat has a size of about a range between 5×5 mm and 25×25 mm. Further, preferably, it has a size of about a range between 10×10 mm and 16×16 mm.

As the warp yarns and the weft yarns for forming the surface layer, the middle layer, and the back layer, the twisted yarn or the non-twisted yarn may be employed.

When the non-twisted yarn is employed for forming the surface layer and the back layer, because the effect (bulkiness caused by the differential shrinkage between the twisted yarn and the non-twisted yarn) produced in the related inventions is added, the bulkiness caused by the wrinkles further improves.

When the twisted yarn is used for forming the surface layer and the back layer, the bulkiness caused by the wrinkles can be realized without using the non-twisted yarn, and thus the manufacturing cost can be saved.

For the multi-ply woven gauze fabric, it is preferable to use the cotton yarn (specifically, pure cotton yarn). Also, it is acceptable to use a blended yarn combined with chemical fibers and plant-derived regenerated fibers such as rayon.

~Basic Concept~

In the honeycomb weave construction, there are a portion including the small number of crossing and a portion including the large number of crossing in each of the warp yarn and the weft yarn. In both the warp yarn and the weft yarn, the portion including the small number of crossing shrinks largely and thus forms a convex/concave shape. Because the shrinkage occurs in proportion to a length of a portion where there is no crossing, a largely shrunk portion in one repeat forms a convex shape and a small shrunk portion in one repeat forms a concave shape, respectively.

On the other hand, in the plain weave construction, the warp yarn and the weft yarn cross at a rate of 1:1, and the yarns interfere with each other. This makes the shrinkage small.

Further, in the honeycomb weave construction, the apex part is formed at a position where the warp yarn and the weft yarn cross to each other in the convex portion. Here, the convex portion and the concave portion have a front-rear relation in the honeycomb weave construction. The connection parts between the surface layer and the middle layer and the connection parts between the back layer and the middle layer, respectively, are made at apex parts.

As a result, the plain weave construction cannot follow the shrinkage of the honeycomb weave construction, and thus the wrinkles occur between connection parts in the surface layer and the back layer.

The differential shrinkage between the plain weave construction and the honeycomb weave construction is noticeably large compared with the differential shrinkage between the twisted yam and the non-twisted yarn. Therefore, the bulkiness caused by the wrinkles improves when compared with the related inventions.

Further, because the honeycomb weave construction itself has the bulkiness, the bulkiness improves more, owing to a synergistic effect, in comparison with the related inventions.

The improvement of the bulkiness contributes to the improvement of the feel of soft touch owing to the wrinkles serving as a cushion.

The improvement of the bulkiness contributes to the improvement of the heat-retaining property because the structure retains therein much air.

The improvement of the bulkiness contributes to the improvement of the transparency preventing property because a distance between the surface layer and the back layer is secured.

The improvement of the bulkiness contributes to the improvement of the lightness more than imagined from the outer appearance. Here, weight per unit area increases slightly in proportion to the shrinkage of the structure.

~Embodiment~

Figure 2:
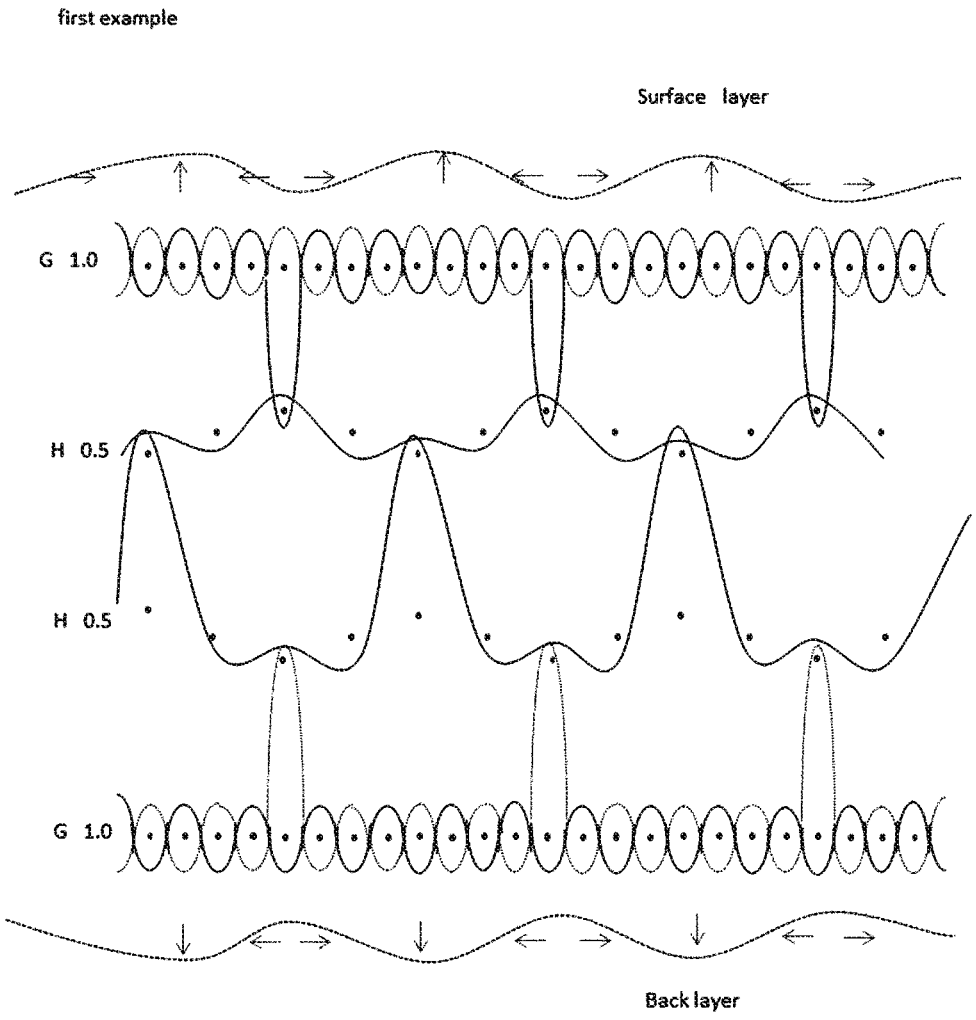
FIG. 2 illustrates a cross section of the multi-ply woven gauze fabric according to First Embodiment.

FIG. 1 schematically illustrates a multi-ply woven gauze fabric according to First Embodiment. For simplification, connection parts are omitted from the illustration. FIG. 2 schematically illustrates a cross section of the multi-ply woven gauze fabric according to First Embodiment.

A surface layer and a back layer are formed into the plain weave construction. A middle layer includes a first middle layer and a second middle layer. The first middle layer and the second middle layer are formed into the honeycomb weave construction.

The surface layer and the first middle layer are joined together via connection parts, and the back layer and the second middle layer are joined together via connection parts. Further, the first middle layer and the second middle layer are joined together via connection parts. Here, the connection parts between the first middle layer and the second middle layer are not essential.

The warp densities of the first middle layer and the second middle layer are half of the warp densities of the surface layer and the back layer. The weft densities of the first middle layer and the second middle layer are half of the weft densities of the surface layer and the back layer. In FIG. 1, the densities are exemplified by 16 warp yarns×16 weft yarns in the surface layer and the back layer, whereas the densities are exemplified by 8 warp yarns×8 weft yarns in the first middle layer and the second middle layer. In other words, in the whole middle layer composed of the first middle layer and the second middle layer, the density is exemplified by 16 warp yarns×16 weft yarns.

The multi-ply woven gauze fabric according to First Embodiment seems to include four layers but has an amount of structure almost equivalent to that of a typical triple gauze fabric.

Figure 3:
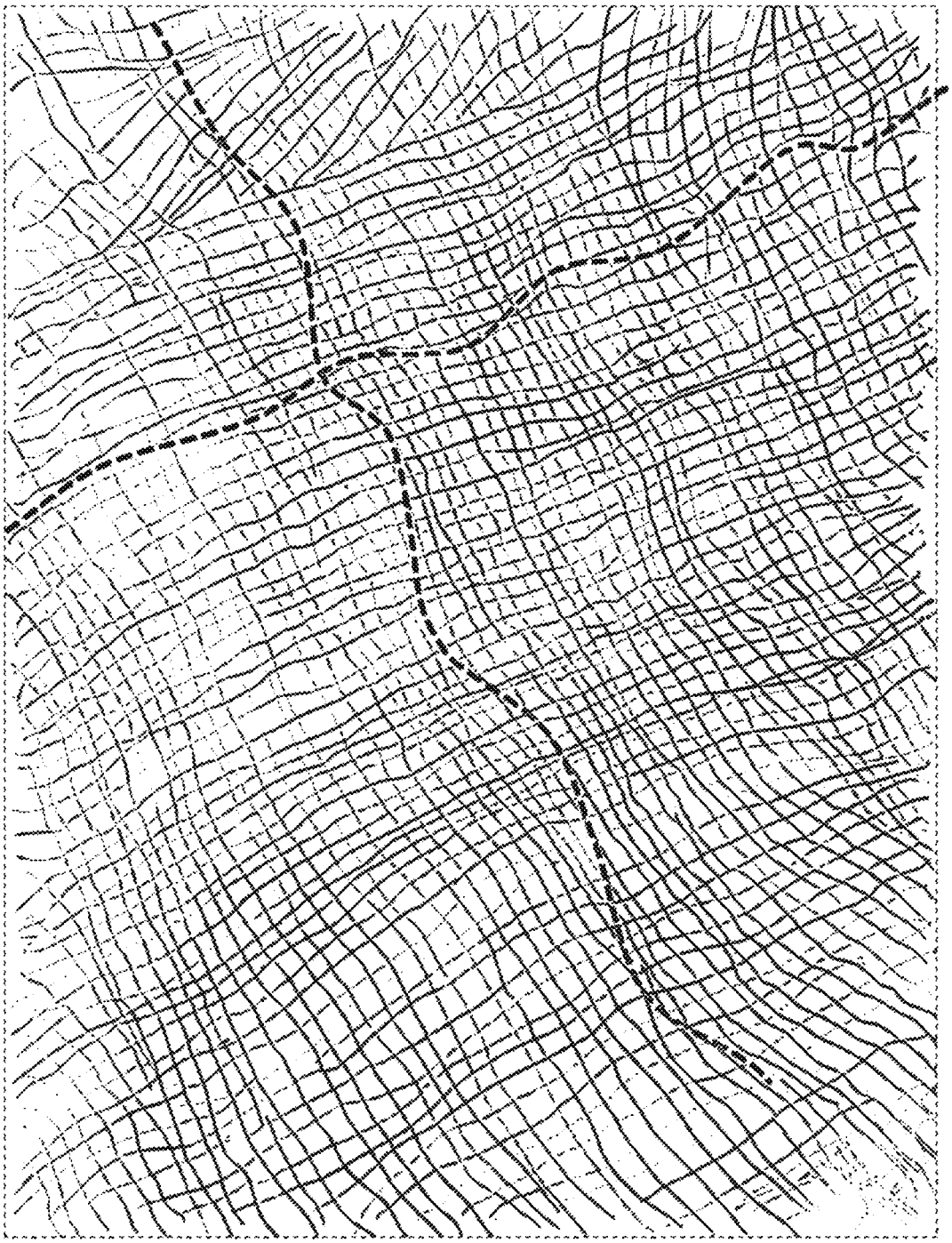
FIG. 3 illustrates an outer appearance of the multi-ply woven gauze fabric according to First Embodiment.

FIG. 3 is an image of the outer appearance of the multi-ply woven gauze fabric according to First Embodiment. In the surface layer (and the back layer), the wrinkles occur between the connection parts. The wrinkles extending in a warp yarn direction and the wrinkles extending in a weft yarn direction are supplementary shown by a dotted line.

Figure 4:
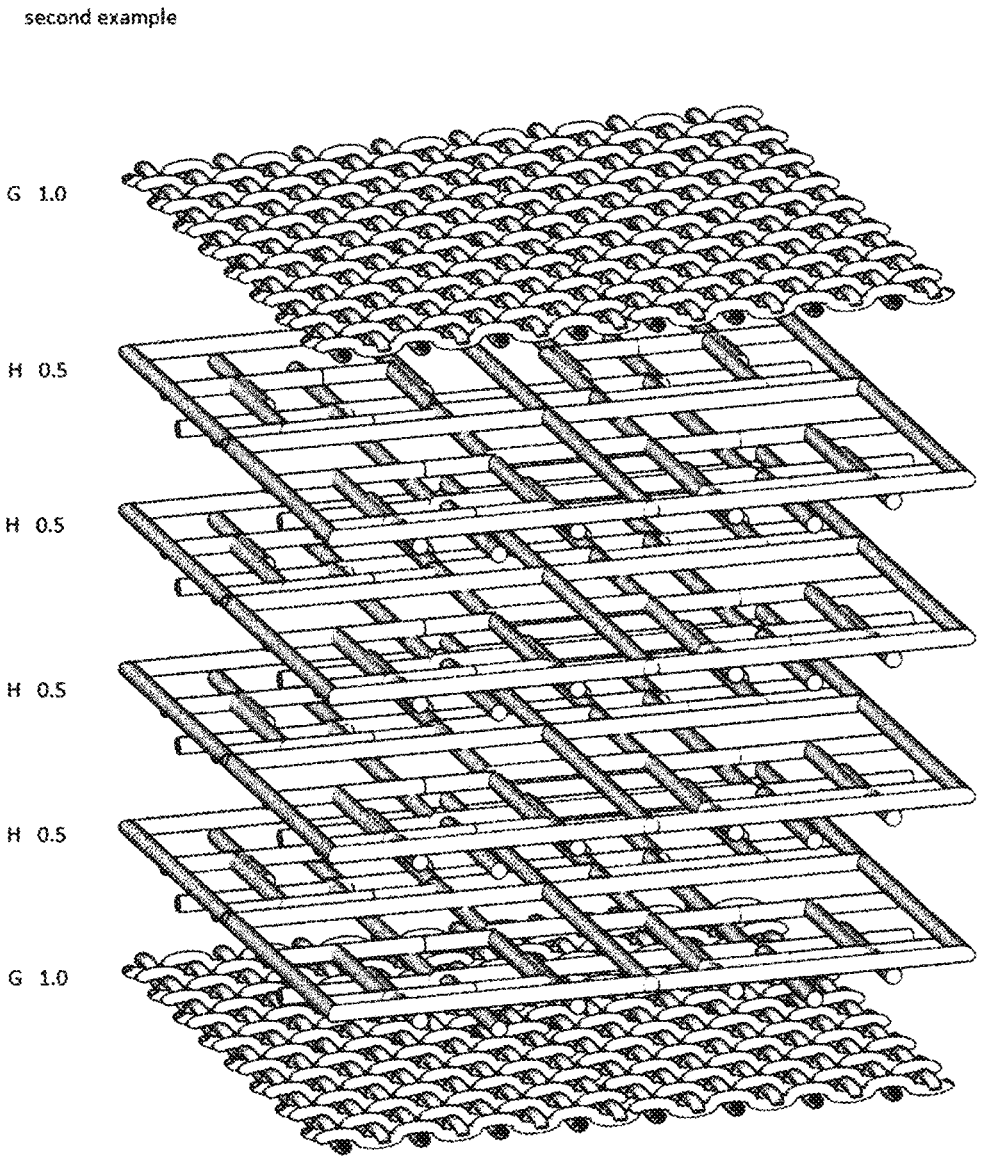
FIG. 4 schematically illustrates a multi-ply woven gauze fabric according to Second Embodiment.

FIG. 4 schematically illustrates a multi-ply woven gauze fabric according to Second Embodiment. A middle layer includes first to fourth middle layers. The first to fourth middle layers are formed into the honeycomb weave construction. The first to fourth middle layers each has a construction density of the half of the construction densities of the surface layer and the back layer.

The multi-ply woven gauze fabric according to Second Embodiment seems to include six layers but has an amount of structure almost equivalent to that of a typical four-ply gauze fabric.

Figure 5:
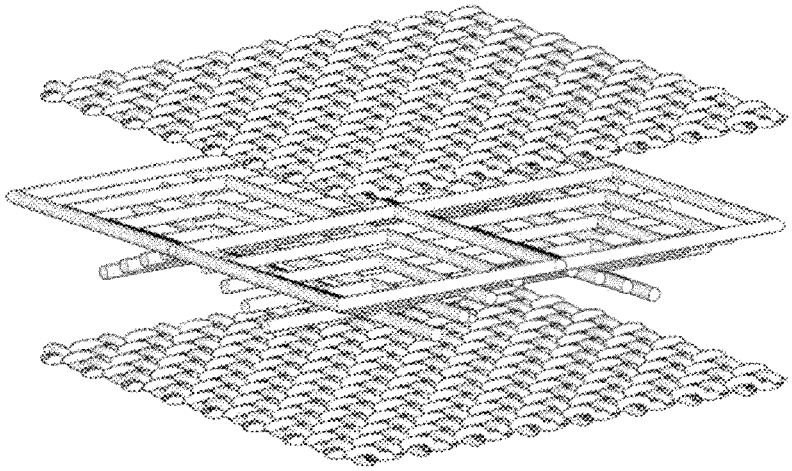
FIG. 5 schematically illustrates a multi-ply woven gauze fabric according to Third Embodiment.

FIG. 5 schematically illustrates a multi-ply woven gauze fabric according to Third Embodiment. A middle layer is a single layer. The middle layer is formed into the honeycomb weave construction.

The warp density of the middle layer is identical to the warp densities of the surface layer and the back layer. The weft density of the middle layer is identical to the weft densities of the surface layer and the back layer. In FIG. 5, the densities are exemplified by 16 warp yams×16 weft yarns in the surface layer and the back layer, and the density is exemplified by 16 warp yarns×16 weft yams in the middle layer.

The multi-ply woven gauze fabric according to Third Embodiment is composed of three layers. The present multi-ply woven gauze fabric has an amount of structure almost equivalent to that of a typical triple gauze fabric.

More specifically, where the gauze fabric of First Embodiment includes four layers and the gauze fabric of Third Embodiment includes three layers, both the fabrics have about the same amount of structure (the total number of the warp yarns and the weft yarns). In other words, in First Embodiment, the number of warp yarns identical to that of Third Embodiment is employed and the warp yarns are divided to form two middle layers.

Figure 6:
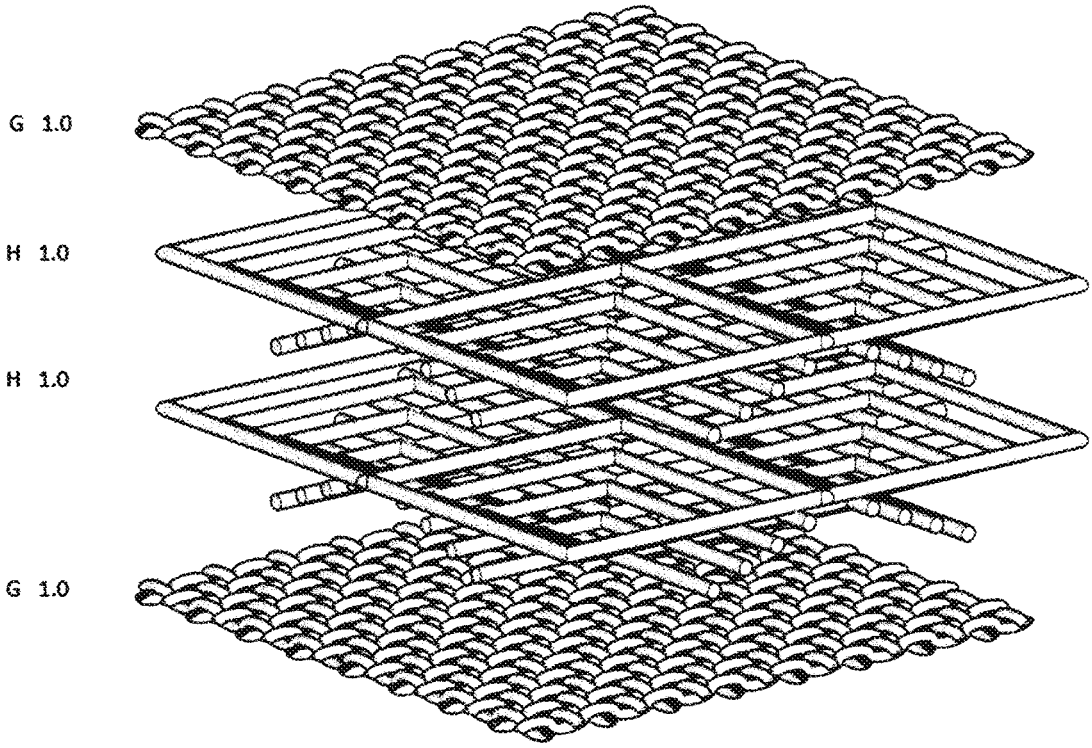
FIG. 6 schematically illustrates a multi-ply woven gauze fabric according to Fourth Embodiment.

FIG. 6 schematically illustrates a multi-ply woven gauze fabric according to Fourth Embodiment. A middle layer includes a first middle layer and a second middle layer. The first middle layer and the second middle layer are formed into the honeycomb weave construction. The construction densities of the first middle layer and the second middle layer are identical to the construction densities of the surface layer and the back layer.

The multi-ply woven gauze fabric according to Fourth Embodiment includes four layers. The fabric has an amount of structure almost equivalent to that of a typical four-ply gauze fabric.

~Comparison of Bulkiness, etc.~

Figure 7:
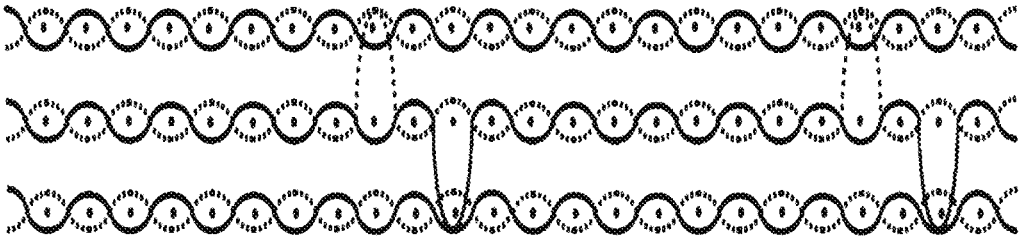
FIG. 7 illustrates a cross section of a multi-ply woven gauze fabric according to Comparative Example 1.

FIG. 7 illustrates a cross section of a multi-ply woven gauze fabric according to Comparative Example 1. Comparative Example 1 is directed to a typical triple gauze fabric. It includes a surface layer, a middle layer, and a back layer. The surface layer, the middle layer, and the back layer are formed into the plain weave construction. The surface layer, the middle layer, and the back layer are formed of the twisted yarn.

Figure 8:
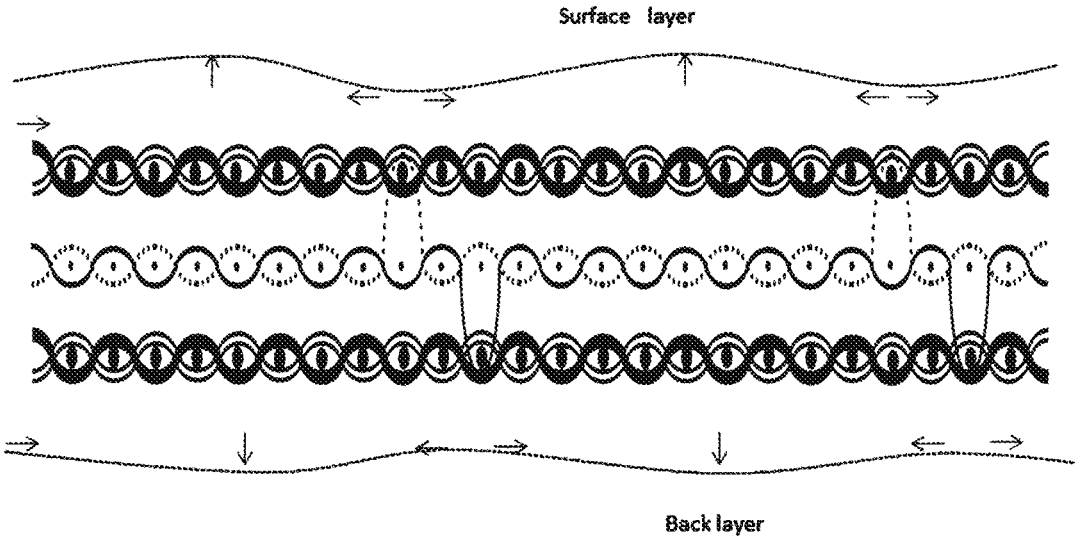
FIG. 8 illustrates a cross section of a multi-ply woven gauze fabric according to Comparative Example 2.

FIG. 8 illustrates a cross section of a multi-ply woven gauze fabric according to Comparative Example 2. Comparative Example 2 is directed to a triple gauze fabric according to the related inventions. It includes a surface layer, a middle layer, and a back layer. The surface layer, the middle layer, and the back layer are formed into the plain weave construction. The surface layer and the back layer are formed of the non-twisted yarn. The middle layer is formed of the twisted yam. In FIG. 8, a thick line represents the non-twisted yarn, and a thin line represents the twisted yarn.

Figure 9:
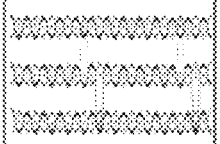
FIG. 9 is a table for effect comparison 1.
Figure 9:
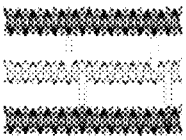
Figure 9:
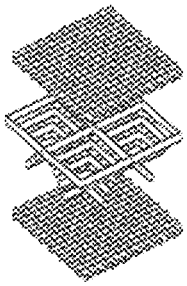
Figure 9:
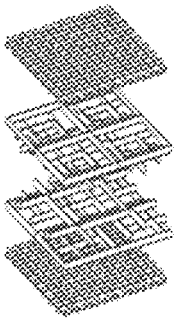

FIG. 9 is a table for effect comparison in which Comparative Example 1, Comparative Example 2, Third Embodiment, and First Embodiment are compared with each other.

As the warp yarn and the weft yarn for forming the surface layer and the back layer, a cotton yam having the English cotton count of 30 was employed. The warp density was set to 32 yarns/inch and the weft density was set to 28 yarns/inch.

As the warp yarn and the weft yarn for forming the middle layer, a cotton yarn having the English cotton count of 20 was employed. The warp density was set to 32 yarns/inch and the weft density was set to 28 yarns/inch. Here, in First Embodiment, the construction density was set to be half. More specifically, the construction densities are almost equivalent to each other between the double middle layers of First Embodiment and the single middle layer of Third Embodiment.

As a result, the amounts of structure are almost equivalent to each other (substantially three layers) among Comparative Example 1, Comparative Example 2, Third Embodiment, and First Embodiment.

Here, the shrinkage in Comparative Example 1 and Comparative Example 2 is about 3-5% for both lengthwise yarns and crosswise yarns, whereas the shrinkage in First Embodiment and Third Embodiment is about 13-14% for both lengthwise yarns and crosswise yarns. As a result, the weight per unit area in First Embodiment and Third Embodiment becomes slightly heavier than the weight per unit area in Comparative Example 1 and Comparative Example 2.

Here, in First Embodiment and Third Embodiment, the twisted yarn was employed for gauze parts of the surface layer and the back layer.

When a comparison is made between Comparative Example 1 and Comparative Example 2, because of the differential shrinkage caused between the twisted yarn and the non-twisted yarn, wrinkles occur in the surface layer and the back layer. This makes the thickness be about 1.5 times.

When a comparison is made between Comparative Example 1 and Third Embodiment, because of the differential shrinkage caused between the plain weave construction and the honeycomb weave construction, wrinkles occur in the surface layer and the back layer. Further, the thickness becomes 2.6 times owing to a synergistic effect between the bulkiness caused by the wrinkles and the bulkiness that the honeycomb weave construction originally has.

When a comparison is made between Comparative Example 1 and First Embodiment, the thickness becomes about 2.9 times.

When a comparison is made between Third Embodiment and First Embodiment, the fabric of First Embodiment is bulkier. More specifically, even when the amount of structure is the same, the middle layer composed of two layers can produce more effect in improving the bulkiness.

Next, in evaluating the lightness in the light of the puffy appearance, the weight per unit area is divided by the thickness to obtain an index of lightness.

The weight per unit area in First Embodiment and Third Embodiment is slightly heavier than the weight per unit area in Comparative Example 1 and Comparative Example 2. Whereas, the index of lightness in First Embodiment and Third Embodiment is remarkably higher than the index of lightness in Comparative Example 1 and Comparative Example 2.

Further evaluation is performed in detail. A comparison between Comparative Example 1 and Comparative Example 2 results in about 64%. Whereas, a comparison between Comparative Example 1 and Third Embodiment results in about 48%, and a comparison between Comparative Example 1 and First Embodiment results in about 41%. The lightness improves remarkably.

More specifically, when the fabrics of First Embodiment and Third Embodiment are employed for cloths and towels of clothes and bedding, the fabrics give a noticeably lighter feeling than imagined from its puffy appearance.

Further, as the bulkiness improves, the heat-retaining property also improves. The breathability as one of the characteristics of the gauze fabric does not degrade too much, i.e., the breathability is not inversely proportional to the improvement of the heat-retaining property.

Here, the thickness was measured in conformity with the standard of JIS L 1096 A method (load of 0.3 kPa), the weight per unit area was measured in conformity with the standard of JIS L 1096, the heat-retaining property was measured in conformity with the standard of JIS L 1018/1096, and the breathability was measured in conformity with the standard of JIS L 1096/1018, respectively.

Figure 10:
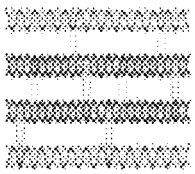
FIG. 10 is a table for effect comparison 2.
Figure 10:
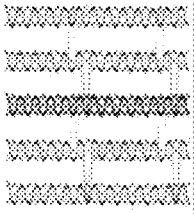
Figure 10:
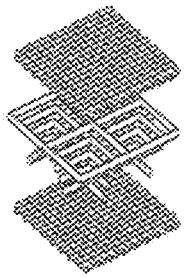
Figure 10:
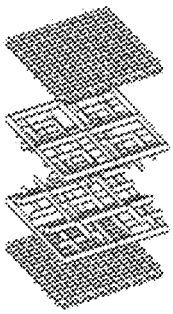

FIG. 10 illustrates a table for effect comparison in which Comparative Example 3, Comparative Example 4, Third Embodiment, and First Embodiment are compared with each other.

Comparative Example 3 is directed to a typical four-ply gauze fabric. Comparative Example 4 is directed to a typical five-ply gauze fabric. They have a structure almost identical to that of Comparative Example 1 other than the number of layers.

The substantial three-ply gauze fabrics of Third Embodiment and First Embodiment are bulkier than the four-ply gauze fabric of Comparative Example 3 and further bulkier than the five-ply gauze fabric of Comparative Example 4. More specifically, the gauze fabrics of Third Embodiment and First Embodiment have excellent bulkiness.

Figure 11:
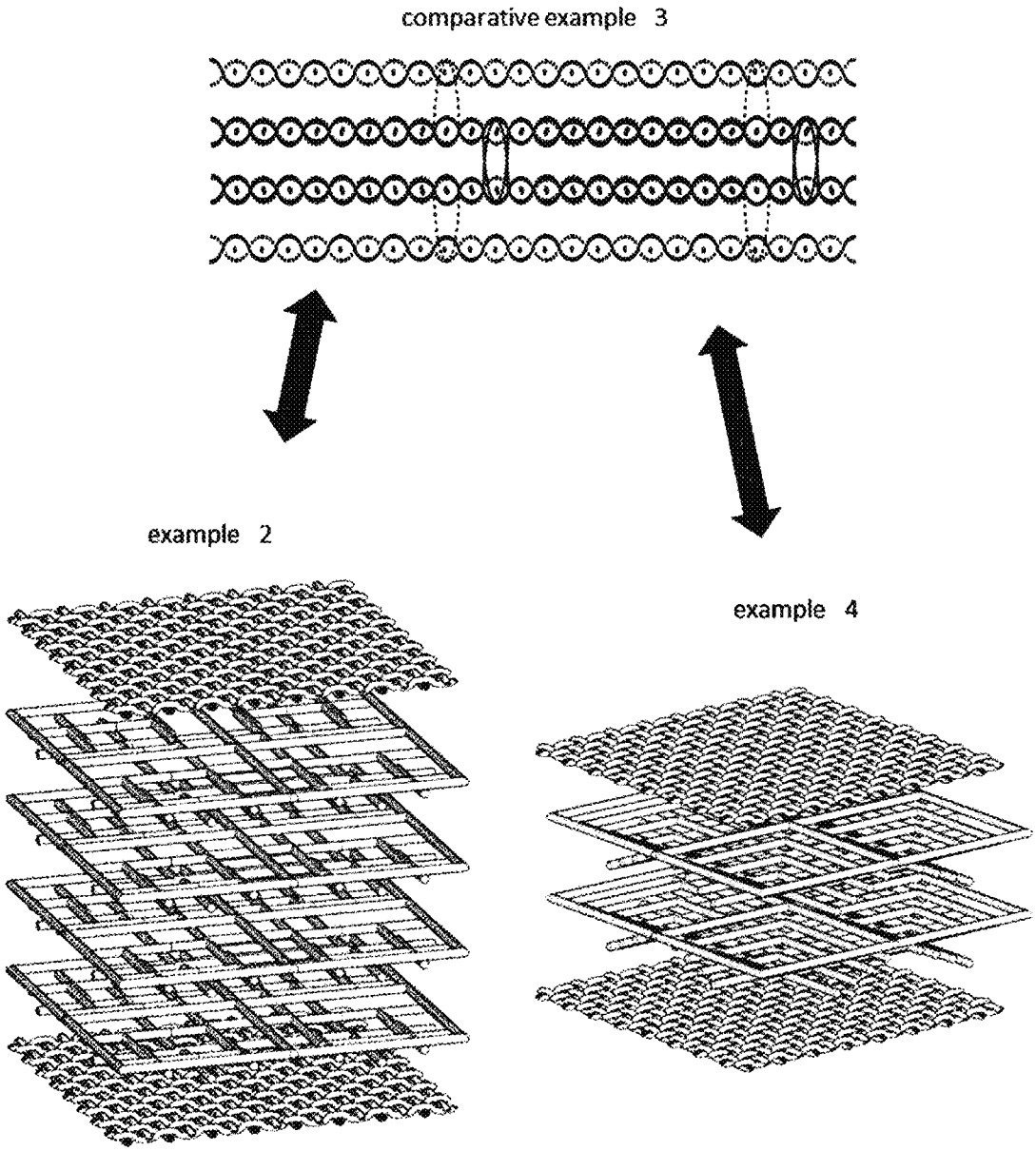
FIG. 11 is an illustration for effect comparison 3.

FIG. 11 is an illustration for effect comparison in which Comparative Example 3, Fourth Embodiment, and Second Embodiment are compared with each other. Comparative Example 3 is directed to a typical four-ply gauze fabric. It is composed of four layers. Each layer has the plain weave construction that is formed of the twisted yarn.

The amount of structure is about the same (substantially four layers) among Comparative Example 3, Fourth Embodiment, and Second Embodiment. Here, the weight per unit area in Second Embodiment and Fourth Embodiment is slightly heavier than the weight per unit area in Comparative Example 3.

More specifically, in the comparison in FIG. 11, a comparison result almost equivalent to that of FIG. 9 was obtained.

~Typical Waffle Weave Towel~

The multi-ply woven gauze fabric of the present invention is characterized in that the middle layer is formed into the honeycomb weave construction. Also, a waffle weave towel commercially available in the market has the honeycomb weave construction. As described below, the middle layer of the present invention, however, differs from the waffle weave towel commercially available in the market.

Figure 12:
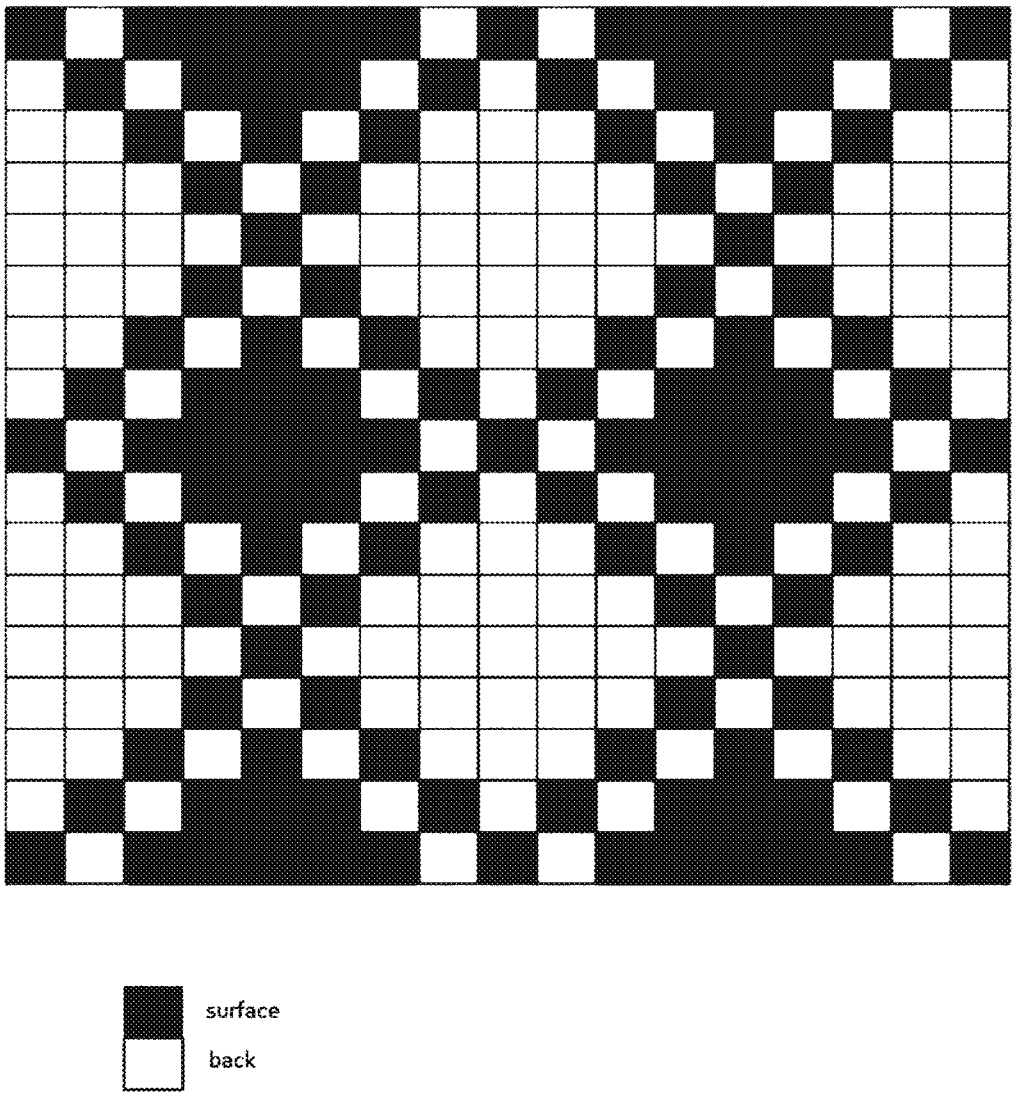
FIG. 12 illustrates a structural view of a typical honeycomb weave construction.
Figure 13:
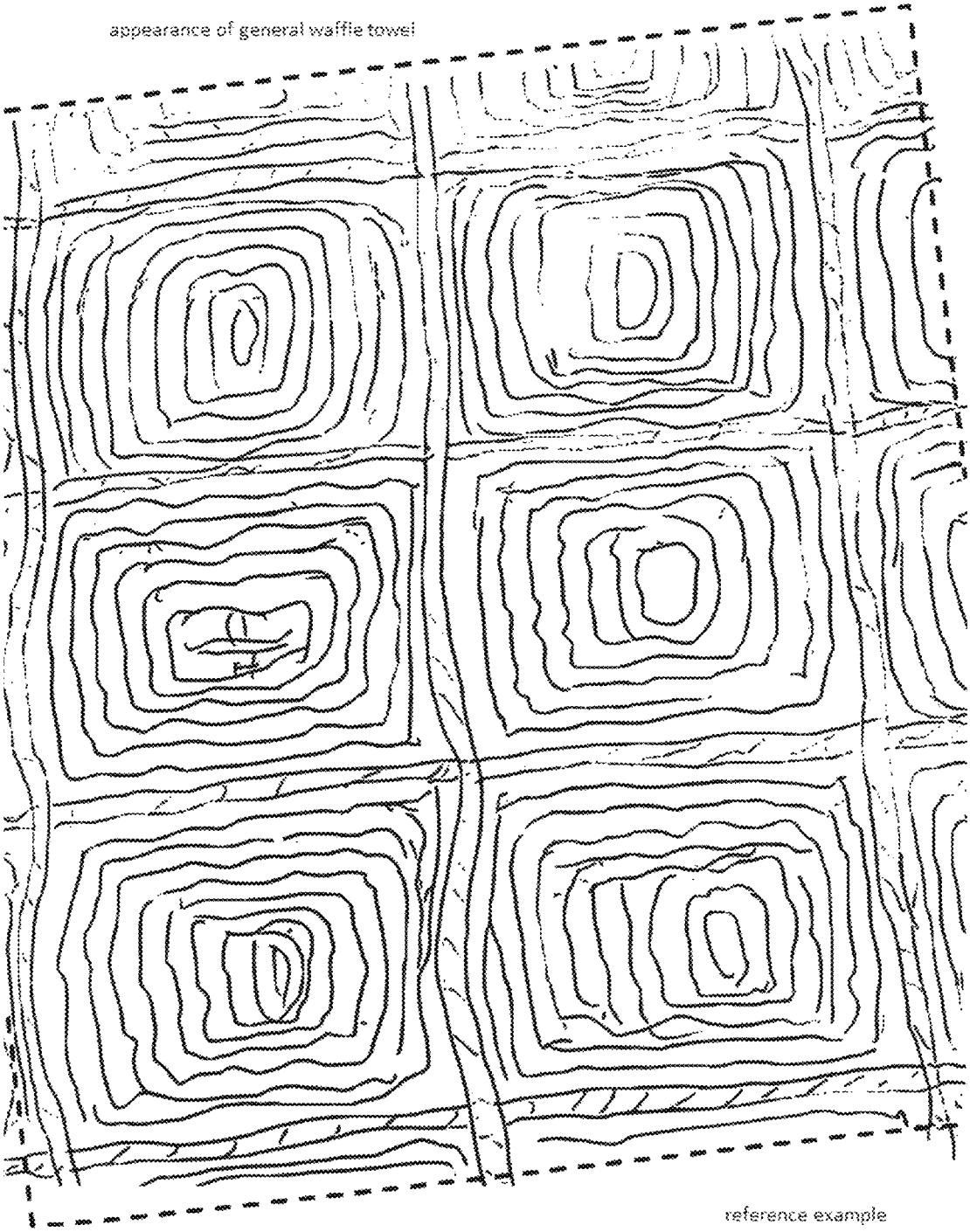
FIG. 13 is an image of a waffle weave towel commercially available in the market.

FIG. 12 illustrates an example of a structure of a typical honeycomb weave construction. FIG. 13 is an image of a waffle weave towel commercially available in the market.

A description about the waffle weave towel commercially available in the market will be given below. Many waffle weave towels are formed of warp yarns and weft yarns which are cotton yarns having the (English) cotton count of a range between 8 and 15 (single yarn conversion). In many waffle weave towels, the number of warp yarns per inch is 30-34 yarns and the number of weft yarns per inch is 30-34 yarns, and the number of yarns for one repeat is 12-32 yarns and the size of one repeat is 10-25 mm. As known from the above, the waffle weave towel has the construction density larger than that of a typical gauze fabric.

According to a simple numerical calculation, a space between yarns becomes about 0.4-0.6 mm. In fact, because of a large influence of the shrinkage of yarns, the space becomes narrower (e.g., below 0.5 mm). In the example of FIG. 13, it is hard to visually recognize the gaps between yarns.

Accordingly, a noticeable convex/concave shape is formed. When the waffle weave towel is brought into light contact with the skin, only the convex parts touch the skin to absorb moisture. The moisture absorbed by the convex parts partially evaporates and partially moves to the concave parts. As a result, the convex parts always maintain a dried state. More specifically, both the water absorbency and the smooth and dry touch feeling is provided concurrently.

To the contrary, in the middle layer of the present invention, for example, a yarn of the (English) cotton count of a range between 20 and 40 (single yarn conversion) is employed. The middle layer is set to have a construction density of 26-34 warp yarns/inch and 26-34 weft yarns/inch (in a case where the middle layer is composed of two layers, the construction density is set to be half).

Figure 14:
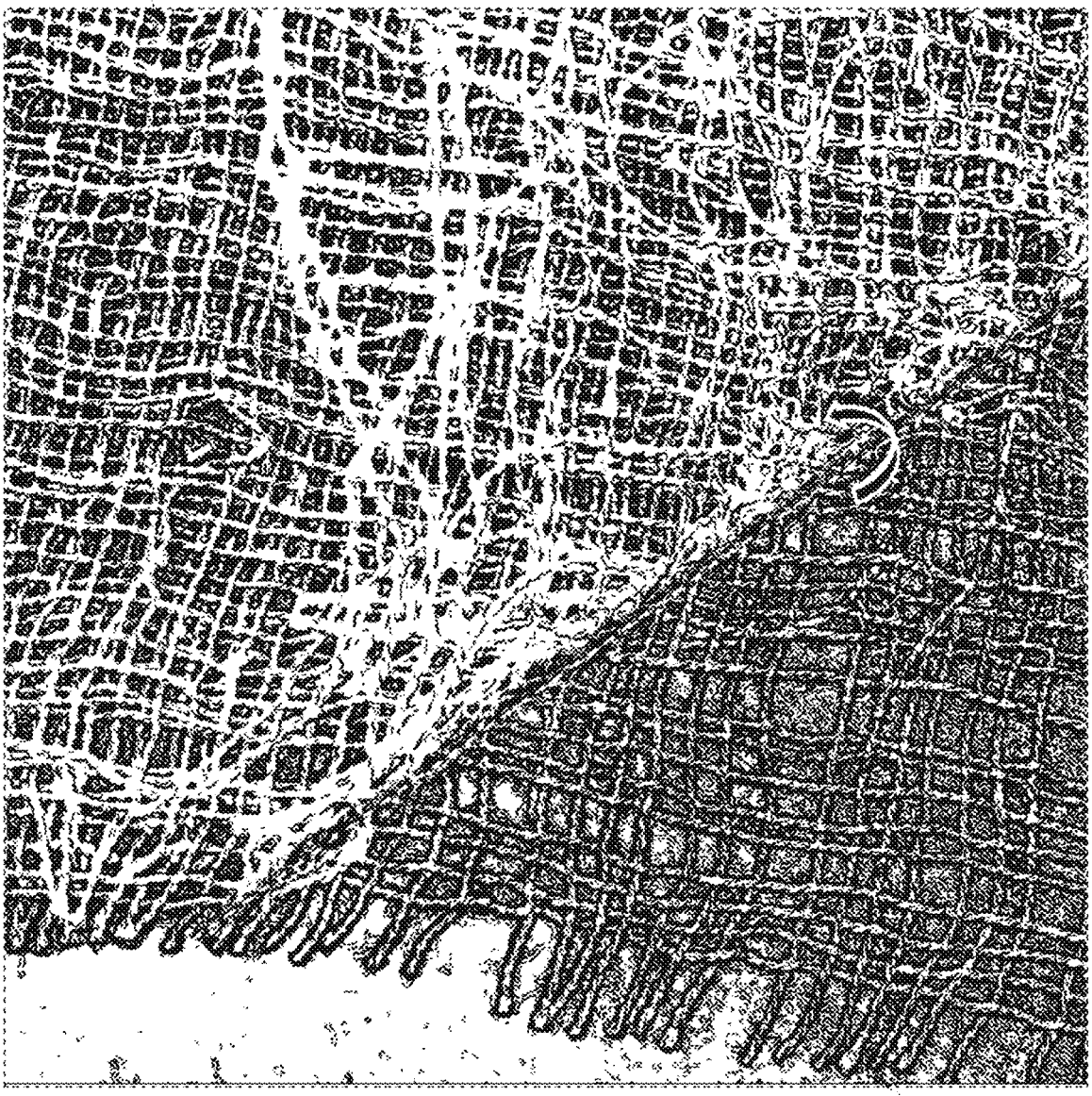
FIG. 14 is an image of outer appearances of a first middle layer (honeycomb weave construction) and a second middle layer (honeycomb weave construction) according to First Embodiment.

FIG. 14 is an image of the outer appearances of the first middle layer and the second middle layer in First Embodiment. The middle layer is formed in such a manner that the first middle layer (honeycomb weave construction) and the second middle layer (honeycomb weave construction) are layered one another. In FIG. 14, the second middle layer is partially turned over to expose the first middle layer. The boundary line is supplementary represented by a dotted line.

More specifically, the middle layer of the present invention has a rough construction density, and thus the effect obtainable from the waffle weave towel cannot be expected. Therefore, it is impossible to use the middle layer singularly as the final product.

According to a simple numerical calculation, a space between yarns becomes about a range between 0.6 and 0.9 mm. Specifically, in a case where the middle layer is divided into two layers, the space between the yarns becomes about a range between 1.2 and 1.8 mm. In the example of FIG. 14, it is easy to visually recognize the gaps between yarns.

As described above, the middle layer of the present invention differs from the waffle weave towel commercially available in the market.

Here, the honeycomb weave construction is a modification example of the plain weave construction. Therefore, the middle layer of the present invention is treated as the modification example of gauze.

~Application of Multi-Ply Woven Gauze Fabric~

In the multi-ply woven gauze fabric of the present invention, the characteristics of the gauze fabric is maintained, and the bulkiness and the effect produced thereby improve as well. As a result, the multi-ply woven gauze fabric of the present invention is suitable to be applied, of course, not only to gauze towels and handkerchiefs but also to cloth for clothing (gowns, pajamas, shirts, pants, scurf, articles for infant, etc.) and beddings (sheets, blankets, pillow covers, etc.).

For example, when a person wears a shirt made of the multi-ply woven gauze fabric of the present invention, the person feels cool in the daytime and warm in the nighttime. More specifically, the multi-ply woven gauze fabric of the present invention can response to the temperature change.

Further, when the multi-ply woven gauze fabric of the present invention is used as a towel, it has the advantageous characteristics of both the gauze fabric and the waffle fabric.

REFERENCE CHARACTER LIST

G plain weave construction
H honeycomb weave construction

The invention claimed is:

1. A multi-ply woven gauze fabric comprising:
a surface layer formed into a plain weave construction;
a middle layer formed into a honeycomb weave construction; and
a back layer formed into the plain weave construction;
wherein the surface layer and the middle layer are joined together via connection parts, and the back layer and the middle layer are joined together via connection parts.

2. The multi-ply woven gauze fabric according to claim 1, wherein the connection parts are made at apex parts of the honeycomb weave construction.

3. The multi-ply woven gauze fabric according to claim 1, wherein wrinkles are formed on the surface layer and the back layer.

4. The multi-ply woven gauze fabric according to claim 1, wherein the surface layer and the back layer are formed of a non-twisted yarn or a soft twist yarn.

5. The multi-ply woven gauze fabric according to claim 1, wherein the surface layer and the back layer are formed of a twisted yarn.

6. The multi-ply woven gauze fabric according to claim 1:
wherein the middle layer comprises a first middle layer and a second middle layer;
wherein warp densities of the first middle layer and the second middle layer are half of warp densities of the surface layer and the back layer; and
wherein weft densities of the first middle layer and the second middle layer are half of weft densities of the surface layer and the back layer.

7. The multi-ply woven gauze fabric according to claim 1:
wherein the middle layer is a single layer;
wherein the warp density of the middle layer is identical to the warp densities of the surface layer and the back layer; and
wherein the weft density of the middle layer is identical to the weft densities of the surface layer and the back layer.

8. The multi-ply woven gauze fabric according to claim 1:
wherein the middle layer comprises first to fourth middle layers;
wherein the warp densities of the first to fourth middle layers are half of the warp densities of the surface layer and the back layer; and
wherein the weft densities of the first to fourth middle layers are half of the weft densities of the surface layer and the back layer.

9. The multi-ply woven gauze fabric according to claim 1:
wherein the middle layer comprises a first middle layer and a second middle layer;
wherein the warp densities of the first middle layer and the second middle layer are identical to the warp densities of the surface layer and the back layer; and wherein the weft densities of the first middle layer and the second middle layer are identical to the weft densities of the surface layer and the back layer.

* * * * *